United States Patent [19]

Hall

[11] 4,334,342

[45] Jun. 15, 1982

[54] CASING HANGER AND STABILIZER

[76] Inventor: Gregory G. Hall, 7800 Youree Dr., Apt. 231, Shreveport, La. 71105

[21] Appl. No.: 117,392

[22] Filed: Feb. 1, 1980

[51] Int. Cl.[3] ..... F16L 21/00; A44B 21/00

[52] U.S. Cl. ..... 24/263 D; 285/144

[58] Field of Search ..... 285/144–148; 24/263 D

[56] References Cited

U.S. PATENT DOCUMENTS

| | | | |
|---|---|---|---|
| 1,343,426 | 6/1920 | Wright | 285/144 X |
| 1,747,782 | 2/1930 | Mahan et al. | 285/148 |
| 1,875,749 | 9/1932 | McEvoy et al. | 285/148 |
| 2,237,683 | 4/1941 | Minor | 285/144 X |
| 2,383,248 | 8/1945 | Garrett | 285/147 |
| 2,733,938 | 2/1956 | Davis | 285/146 |
| 3,454,289 | 7/1969 | Fowler | 285/144 |
| 3,561,531 | 2/1971 | Miller | 166/285 |

*Primary Examiner*—Dave W. Arola

[57] ABSTRACT

A casing hanger and stabilizer for use during the setting and cementing of surface casing in oil and gas wells, which includes a pair of generally wedge-shaped slip segments having mating faces and removably joined at the faces by a pair of plates, and further provided with interior slip threads or teeth for engaging the surface casing and a plurality of slots in the longitudinal exterior surface to permit the pumping of drilling mud or other fluid between the supporting conductor pipe and the suspended surface casing prior to cementing the surface casing in the conductor pipe.

5 Claims, 7 Drawing Figures

CASING HANGER AND STABILIZER

BACKGROUND OF THE INVENTION

1. Field of the Invention

This invention relates to the suspension of surface casing inside conductor pipe in oil and gas wells, and more particularly, to a casing hanger device designed to expedite the cementing of the surface casing inside the conductor pipe and the cutting of the casing prior to the setting of the cement in order to facilitate mounting of a blow-out preventer stack on the surface casing in a relatively short period of time.

2. Description of the Prior Art

Conventional cementing of surfacing casing inside conductor pipe requires the suspension and cementing of a desired length of casing at a specified depth in the well. A length of conductor pipe is first run into the well to a specified depth, and the surface casing is subsequently suspended inside the conductor pipe, with cement pumped in the annulus between the conductor pipe and the surface casing prior to cutting the casing and mounting blow-out preventers on the casing. Typical of the methods for achieving the objective of suspending surface casing in a well is the technique set forth in U.S. Pat. No. 3,561,531 to Terrell V. Miller. This patent is directed to a method for suspending well pipe strings in wells which are particularly susceptible to subsidence of adjacent earth formations. A rather critical procedure in such a casing suspension technique is the cementing of the casing to the well bore. A period of from at least one to about twelve hours is generally necessary to permit the cement to securely set before cutting the casing and nippling up the blow-out preventers. Cutting the casing prior to a specified cement setting time frequently causes the cement bond to the casing or well bore to be broken, a condition which can be quite dangerous in the event of a "blow-out" or release of high pressure gas from the well to the surface. Conventional casing hangers are generally designed to seal the annulus between the surface casing and production casing, and are insufficiently tapered and too expensive to be used to secure surface casing in suspended position inside the conductor tubing to sufficiently stabilize the casing.

In the course of drilling relatively deep wells, after the conductor pipe is set a casing hole of selected diameter is drilled and casing of selected size is run in the hole. Cement is then pumped in the annulus between the casing and conductor pipe, and drilling begins after the cement sets. If the cement is not dry and strong, it frequently breaks due to the rotary action of the drill pipe string, and this "wobbling" and vibrating action wears the casing. In extreme cases, the drilling may wear a hole in the casing.

Accordingly, it is an object of this invention to provide a new and improved casing hanger and stabilizer which is characterized by a pair of wedge-shaped slips designed for mounting on the casing string and supported by the conductor casing to suport and stabilize the casing string while the casing concrete is setting and to permit the casing to be cut at a point between the casing hanger and the rig floor.

Another object of the invention is to provide a casing hanger and stabilizer which serves the dual function of supporting a string of surface casing and stabilizing the casing during drilling to prevent the casing from "wobbling" and vibrating due to rotation of the drill pipe.

Yet another object of the invention is to provide a new and improved casing hanger which includes a pair of matching, wedge-shaped slips which are designed to wedge in the top of a length of conductor pipe after the pipe is cut, and to support and stabilize a string of surface casing after the casing cement is pumped and prior to cutting the casing in order to facilitate mounting of the blow-out preventer stack.

Another object of the invention is to provide a new and improved casing hanger which is characterized by a pair of wedge-shaped slip segments designed for positioning in the conductor pipe by wedging the slips in the conductor pipe opening, and fitted to receive and suspend a length of surface casing inside the conductor pipe after cementing of the surface casing to the well bore and conductor pipe.

Another object of this invention is to provide a new and improved, wedged casing hanger and stabilizer which wedges in one end of the conductor pipe to suspend a length of surface casing inside the conductor pipe and undisturbed in cement to permit the surface casing to be cut prior to the 1 to 12 hour setting time generally required in the casing-setting operation.

Yet another object of this invention is to provide a new and improved, wedge-shaped casing hanger and stabilizer which is simple in design and which utilizes the conductor pipe as a bowl, and which is designed to grip and suspend the surface casing inside the conductor pipe during or after the cementing operation.

Yet another object of this invention is to provide a new and improved casing hanger and stabilizer for suspending and stabilizing surface casing inside the conductor pipe of a well after the cementing of the surface casing to the conductor pipe and the well bore, which casing hanger is generally wedge-shaped and is provided with a plurality of slots longitudinally machined in the two slip segments to permit drilling mud or other fluid to be pumped through the annulus between the conductor pipe and the surface casing prior to the setting of cement or during the drilling operation.

A still further object of the invention is to provide a new and improved casing hanger and stabilizer which is characterized by a pair of wedge-shaped slip segments having mating faces which may be removably joined by a pair of plates to suspend and stabilize a string of surface casing inside a conductor pipe for the purpose of first cementing the surface casing to the well bore or conductor pipe, then cutting the surface casing prior to setting of the cement, and subsequently stabilizing the surface casing during the drilling operation.

SUMMARY OF THE INVENTION

These and other objects of the invention are provided in a casing hanger and stabilizer which is characterized by a pair of matching, wedge-shaped slip segments having interior threads or teeth, and a plurality of slots provided in the faces thereof to permit fluids to flow past the segments, and further provided with a pair of removable plates for joining the segments at matching faces around a segment of surface casing to permit suspension of the surface casing inside a length of conductor pipe in an oil or gas well in order to stabilize the surface casing in position after the cementing operation has been accomplished and during drilling of the well.

BRIEF DESCRIPTION OF THE DRAWING

The invention will be better understood by reference to the accompanying drawing, wherein.

DESCRIPTION OF THE PREFERRED EMBODIMENTS

Figure 1:
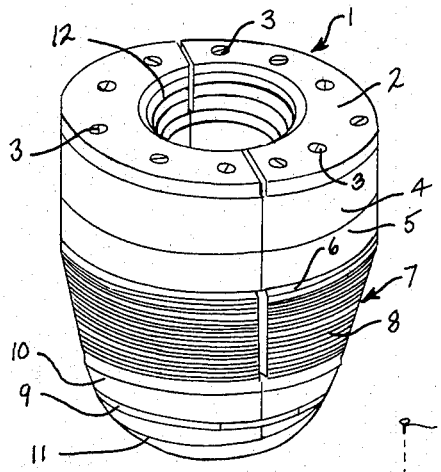
FIG. 1 (PRIOR ART)
FIG. 1 is a perspective view of a casing hanger generally used in the prior art.

Referring now to FIG. 1 of the drawing, a conventional casing hanger used in the prior art is illustrated, and is generally indicated by reference numeral 1. Conventional casing hanger 1 generally characterizes a conventional, wrap-around casing hanger designed to suspend and seal both heavy and light casing strings in oil and gas wells without damage to the casing. Conventional casing hanger 1 is characterized by an upper slip 2 and a slip support ring 4, which are joined by cap screws 3. A seal ring 5 is provided beneath slip support ring 4 and is biased in place by means of seal support ring 6. A tapered bowl 7 is provided with a plurality of bowl teeth or threads 8, and lower slips 10 are fitted to conventional casing hanger 1 immediately beneath bowl 7, with a latch 9 provided as illustrated. A tapered guide 11 permits easy access of conventional casing hanger 1 into a supporting tube or pipe and a plurality of slip threads 12 are provided in the interior of conventional casing hanger 1 in order to engage the surface casing.

Figure 2:
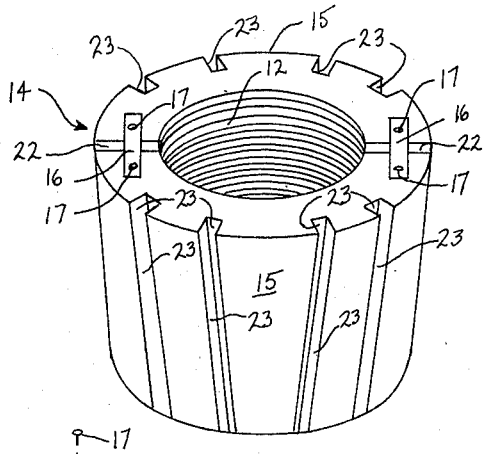
FIG. 2 is a perspective view of the casing hanger of this invention.
Figure 3:
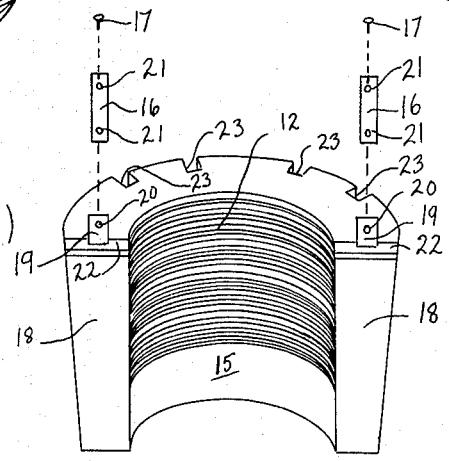
FIG. 3 is a perspective view of one of the slip segments of the casing hanger illustrated in FIG. 2.

Referring now to FIGS. 2–6 of the drawing, the casing hanger of this invention is generally illustrated by reference numeral 14, and includes a pair of generally wedge-shaped slip segments 15 which match along slip faces 18, as illustrated in FIG. 3. Slip segments 15 are removably held in position as illustrated in FIGS. 2 and 4–6 by means of a pair of plates 16, each of which is provided with plate apertures 21 and is designed to mate with plate slots 19 provided in the top spaces of slip segments 15, as illustrated in FIG. 3. Furthermore, face slots 22 are also provided in the mating slip faces 18 of casing hanger 14 and are used to help align slip segments 15 and to fit plates 16 into plate slots 19. Plates 16 are secured to slip segments 15 by means of plate bolts 17, which may be characterized as socket head cap screws or slot head cap screws, as desired.

Figure 5:
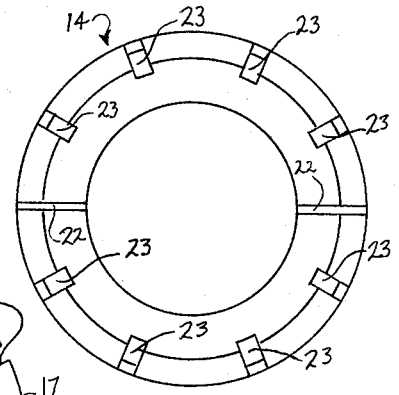
FIG. 5 is a bottom elevation of the casing hanger illustrated in FIG. 2.
Figure 7:
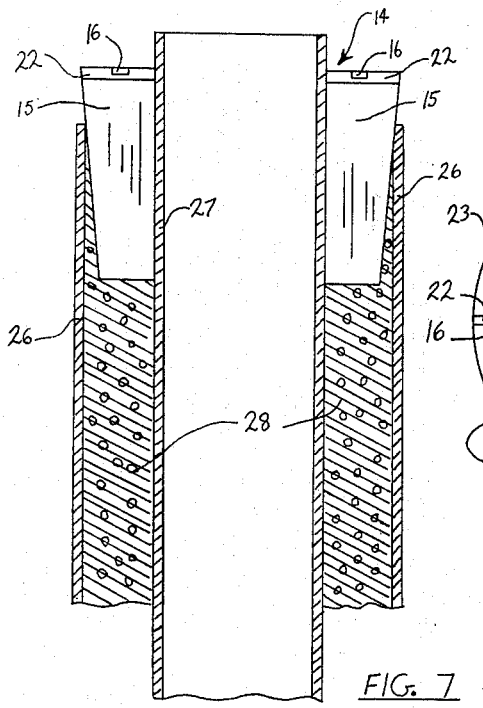
FIG. 7 is a sectional view of the casing hanger illustrated in FIG. 2 in functional position wedged into the top of a conductor pipe and carrying a surface casing, with cement provided in the annulus between the surface casing and the conductor pipe.
Figure 4:
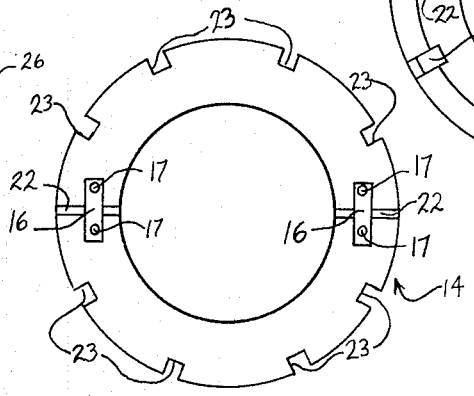
FIG. 4 is a top elevation of the casing hanger illustrated in FIG. 2.
Figure 6:
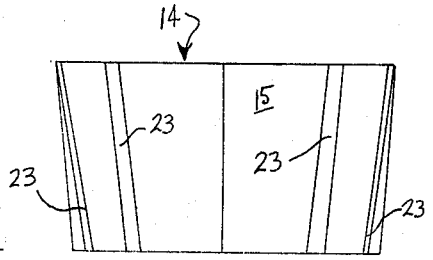
FIG. 6 is a side elevation of the casing hanger illustrated in FIGS. 2–5.

Referring specifically to FIGS. 2, 6 and 7 of the drawing, in a preferred embodiment of the invention casing hanger 14 is provided with a plurality of slots 23 in the outside longitudinal faces of slip segments 15 in order to provide a means by which fluid, such as drilling mud, concrete, or the like, can be circulated in the annulus between conductor pipe 26 and surface casing 27, as illustrated in FIG. 7 of the drawing. In a most preferred embodiment of the invention the taper of casing hanger 14 from the top surface of slip segments 15 to the bottom surface of the segments as illustrated in FIGS. 4 and 5 of the drawings, is about five degrees, and the taper of slots 23 and the longitudinal faces of slip segments 15, is about ten degrees.

Referring now specifically to FIG. 7 of the drawing, in a typical operation, a specified length of conductor pipe 26 is first set in a previously prepared well bore, a casing hole is drilled, and casing is set, with concrete pumped into the well to secure the casing in place. The conductor pipe is then cut, and the casing hanger 14 of this invention is then utilized by first removing plate bolts 17 from plates 16 and plate slot apertures 20 of slip segments 15. Slip segments 15 are then divided, as illustrated in FIG. 3. Slip segments 15 are subsequently placed around the length of surface casing 27 extending from the rig floor into the well, as illustrated in FIG. 7, and plates 16 are again mounted to slip segments 15 by means of plate bolts 17 to secure surface casing 27 inside casing hanger 14. Engagement of slip threads 12 of casing hanger 14 with the surface casing 27, and slip segments 15 with the interior surface of conductor pipe 26, is effected, as illustrated in FIG. 7 of the drawing when casing hanger 14 is positioned on surface casing 27. When casing 27 is cut, the weight of the string of surface casing 27 causes slip threads 12 in the interior of slip segments 15 to securely engage the exterior surface of surface casing 27, and prevent the surface casing string from falling into the well. Whereas, as heretofore described, in conventional cementing operations the cement must be permitted to dry before the top of surface casing 27 extending above the well can be cut preparatory to mounting the blow-out preventer stack on the casing, when casing hanger 14 is used, the surface casing 27 can be immediately cut as soon as the casing hanger is mounted on the casing, thereby eliminating a delay of some one to twelve hours in the job. Furthermore, the positioning of casing hanger 14 in position on the conductor pipe 26 and the surface casing 27 as illustrated in FIG. 7 prevents movement of surface casing 27 when drill pipe is positioned inside the casing and drilling begins.

It will be recognized by those skilled in the art that the casing hanger of this invention can be manufactured of substantially any material known to those skilled in the art for use in the above described manner. For example, casing hanger 14 can be manufactured of stainless steel or mild steel, as desired. Furthermore, the device is simple in design and operation, thereby permitting rapid maintenance and quick and easy installation on the surface casing. Unlike conventional casing hangers, the casing hanger of this invention is characterized by only two basic functional parts; slip segments 15, which are joined by two plates 16 and cooperating plate bolts 17, as heretofore described. Accordingly, there are few moving parts to become clogged, jammed or to malfunction during suspension and stabilization of the casing string. The casing hanger of this invention is also light in weight when compared to its conventional counterparts and can be quickly and easily assembled and disassembled in the field with minimum instruction.

As heretofore described, the casing hanger of this invention is characterized by multiple slots 23, which permit the circulation of fluid in the annulus between the conductor pipe and the surface casing. Casing hanger 14 does not seal the annulus as in the case of conventional hangers. Furthermore, there is no necessity of providing special head such as a "Braden" head for suspending the casing hanger, and in a preferred embodiment of the invention the casing hanger is provided with a straight rather than a tapered or a curved wedge for simplicity of manufacture and operation.

Having described my invention with the particularity set forth above, what is claimed is:

1. A casing hanger and stabilizer comprising a pair of matching, wedge-shaped slip segments characterized by a straight taper from a selected maximum diameter at the top thereof to a selected minimum diameter at the bottom, each of said slip segments having a top surface and an internal bore in matching relationship to the other, and provided with threads in said internal bore, and further provided with a plurality of slots in the longitudinal external surface thereof, and a pair of plate slot apertures in the top surface of said slip segments, a pair of plates in registration with said plate slot apertures, and cooperating plate bolts for removably joining said plates to said slip segments.

2. The casing hanger of claim 1 wherein said plurality of slots is eight slots provided in spaced relationship in said slip segments, and wherein said segments are provided with a first taper of about five degrees from top to bottom of said segments, and said slots are provided with a second taper of about ten degrees from top to bottom of said slots.

3. A casing hanger and stabilizer comprising:

(a) a pair of half-round, wedge-shaped, matching slip segments, each having a top surface and a bottom surface and an internal, half-round bore, and an exterior half round surface and provided with threads in at least a portion of said bore;

(b) a plurality of slots provided in spaced relationship in the exterior surface of said slip segments and joining said top surface and said bottom surface;

(c) a pair of oppositely disposed plate slots and plate slot apertures in said top surface of said slip segments; and (d) a pair of plates registering with said plate slots, and plate bolts cooperating with said plates and threadably registering with said plate slot aperture to removably mount said plates on said slip segments and join said slip segments together.

4. The casing hanger of claim 3 wherein said slip segments are further characterized by a straight taper of about five degrees from a selected maximum diameter at said top surface to a selected minimum diameter at said bottom surface.

5. The casing hanger of claim 4 further comprising a pair of face slots in said top surface of said slip segments in transverse relationship to said plate slots and extending from said exterior surface to said bore and wherein said plurality of slots are further characterized by a slot taper of about ten degrees from the top of said slots in said slip segments to the bottom of said slots in said slip segments.

* * * * *